US006412927B1

(12) United States Patent
Takahashi

(10) Patent No.: US 6,412,927 B1
(45) **Date of Patent: *Jul. 2, 2002**

(54) INK EJECTION DEVICE FOR FORMING HIGH DENSITY DOT IMAGE BY SUCCESSIVELY EJECTING TWO OR MORE INK DROPLETS

(75) Inventor: Yoshikazu Takahashi, Nagoya (JP)

(73) Assignee: Brother Kogyo Kabushiki Kaisha, Aichi-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/069,776

(22) Filed: Apr. 30, 1998

(30) Foreign Application Priority Data

Apr. 30, 1997 (JP) ..... 9-112746

(51) Int. Cl.[7] ..... B41J 2/045
(52) U.S. Cl. ..... 347/71
(58) Field of Search ..... 347/15, 10, 11, 347/12, 43, 68–72

(56) References Cited

U.S. PATENT DOCUMENTS 4,686,539 A * 8/1987 Schmidle et al. ..... 347/11
4,879,568 A 11/1989 Bartky et al.
4,887,100 A 12/1989 Michaelis et al.
4,992,808 A 2/1991 Bartky et al.
5,003,679 A 4/1991 Bartky et al.
5,028,936 A 7/1991 Bartky et al.
5,202,659 A * 4/1993 DeBonte et al. ..... 347/11
5,610,637 A * 3/1997 Sekiya et al. ..... 347/10
5,621,447 A * 4/1997 Takizawa et al. ..... 347/88
5,657,060 A * 8/1997 Sekiya et al. ..... 347/15
5,717,448 A * 2/1998 Inada ..... 347/43
5,729,257 A * 3/1998 Sekiya et al. ..... 347/9
5,790,152 A * 8/1998 Harringto ..... 347/48
5,877,786 A * 3/1999 Sekiya et al. ..... 347/15

FOREIGN PATENT DOCUMENTS

JP 63-247051 10/1988
JP 08-090777 4/1996
JP 9-57960 3/1997

* cited by examiner

*Primary Examiner*—Benjamin R. Fuller
*Assistant Examiner*—C. Dickens
(74) *Attorney, Agent, or Firm*—Connolly Bove Lodge & Hutz LLP

(57) ABSTRACT

An ink ejection device that is capable of forming a high density dot image on a recording medium by successively ejecting two ink droplets. Drive timings of an actuator are appropriately set so that the two ink droplets do not join together during their flight times toward the recording medium. Because the ink ejection device moves relative to the recording medium, the two ink droplets deposited on the recording medium partially overlap one on the other, thereby enlarging an area where the ink is deposited.

29 Claims, 6 Drawing Sheets

FIG. 4(a)
FIG. 4(b)
FIG. 4(c)
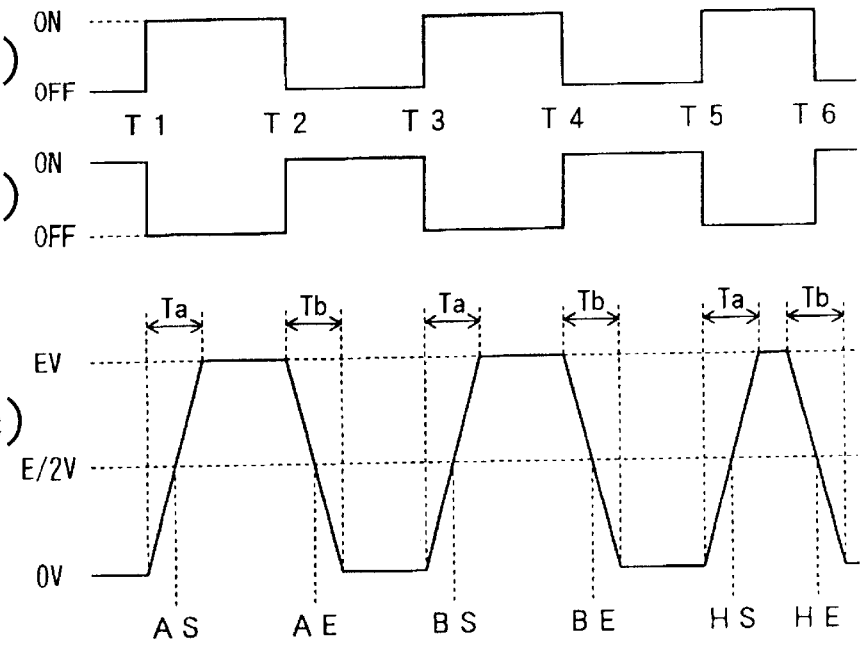
FIG. 5
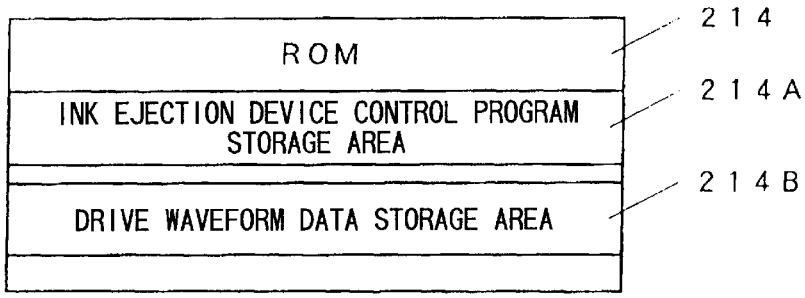

INK EJECTION DEVICE FOR FORMING HIGH DENSITY DOT IMAGE BY SUCCESSIVELY EJECTING TWO OR MORE INK DROPLETS

BACKGROUND OF THE INVENTION

1. Field of the Invention

The present invention relates to an ink ejection device for forming images on a recording medium by electing ink droplets from nozzles according to printing commands.

2. Description of the Related Art

Non-impact type printing devices have recently taken the place of conventional impact type printing devices and are holding an ever-growing share of the market. Of these non-impact type printing devices, ink-ejecting type printing devices have the simplest operation principle, but are still capable of effectively and easily performing multi-gradation and color printing. Of these devices, a drop-on-demand type for ejecting only ink droplets which are used for printing has rapidly gained popularity because of its excellent ejection efficiency and low running cost.

A shear mode type printer using a piezoelectric actuator is one of the drop-on-demand types. Such a printer is disclosed in U.S. Pat. No. 4,879,568. One example of such type of printer is shown in FIGS. 1(*a*) and 1(*b*) in which FIG. 1(*a*) is a cross-sectional view taken along line A—A in FIG. 1(*b*) an FIG. 1(*b*) is also a cross-sectional view taken along line B—B in FIG. 1(*a*).

As shown in FIGS. 1(*a*) and 1(*b*), the shear mode type ink ejection device 600 includes a bottom wall 601, a ceiling wall 602, and elongated shear mode actuator walls 603 sandwiched therebetween. Each actuator wall 603 includes a lower wall 607 adhesively attached to the bottom wall 601 and an upper wall 605 adhesively attached to the ceiling wall 602. The upper and lower walls 605, 607 are polarized in the directions indicated by arrows 609, 611, respectively. Alternating pairs of actuator walls 603 form in alternation ink channels 613 therebetween or spaces 615, which are narrower than the ink channels 613.

Electrodes 619 and 621 are provided on both side surfaces of each actuator wall 603. Specifically, the electrode 619 is provided in the ink channel 613 and the electrode 621 is provided in the space 615. The electrode 621 is also provided on the outer side surface of each of the two outermost actuator walls 603. The electrode 619 is covered by an insulating layer (not shown) to insulate it from the ink. The electrodes 621 are connected to ground 623. The electrodes 619 are connected to a control unit 625 in a form of a silicon chip which applies voltages (driving signals) to the electrodes 619 as will be described later.

A nozzle plate 617 is fixedly secured to one end of the actuator walls 603. The nozzle plate 617 is formed with nozzles 618 at positions corresponding to the ink channels 613. An ink supplying source (not shown) is connected to the other end of the actuator walls 603 through a manifold 626. The manifold 626 includes a front wall 627 formed with openings in positions corresponding to the ink channels 613, and a rear wall 628 for sealing the space between the bottom wall 601 and the ceiling wall 602. Ink from the ink supplying source is supplied to the manifold 626 or common ink chamber and distributed into the respective ink channels 613. The front wall 627 prevents ink from the manifold 626 from entering the spaces 615.

To eject droplets, a voltage from the control unit 625 is applied to the electrode 619 of each ink channel 613. Pairs of the actuator walls 603 deform outward by the piezoelectric shear effect so that the volume of each ink channel 613 increases. In the example shown in FIG. 2, when a voltage E volts is applied to the electrode 619*c* of the ink channel 613*c*, an electric field is developed in the actuator wall 603*e* in the direction indicated by the arrow 631, and an electric field is developed in the actuator wall 603*f* in the direction indicated by the arrow 632. Because the electric field directions 631 and 632 are at right angles to the polarization direction 609, 611, the actuator walls 603*e*, 603*f* deform outward to increase the volume of the ink channel 613*c* by the piezoelectric shear effect, resulting in a decrease in the pressure in the ink chamber 613*c*, including near the nozzle 618*c*.

Application of the voltage E(V) is maintained for a duration of time T, during which time ink is supplied from the ink supplying source. A pressure wave occurring when the ink is supplied from the ink supplying source propagates in the lengthwise direction of the ink channel 613*c*. The duration of time T corresponds to a duration of time required for the pressure wave to propagate once in the lengthwise direction of the ink channel 613*c*. The duration of time T (hereinafter referred to as "pressure wave propagation time") can be calculated by the following formula:

$$T=L/a$$

wherein L is the length of the ink channel 613; and a is the speed of sound through the ink filling channel 613*c*.

Theories on pressure wave propagation teach that at the moment the duration of time L/a elapses after the application of the voltage, the pressure in the ink channel 613*c* inverts to a positive pressure. The voltage application to the electrode 619*c* of the ink channel 613*c* is stopped in timed relation with this pressure inversion so that the actuator walls 603*e*, 603*f* revert to their initial shape shown in FIG. 1(*a*).

The pressure generated when the actuator walls 603*e*, 603*f* return to their initial shape is added to the inverted positive pressure so that a relatively high pressure is generated in the ink channel 613*c*. This relatively high pressure ejects an ink droplet 26 from the nozzle 618*c*.

In the ink ejection device 600 of the type described above, a dot formed by continuously ejected two or more ink droplets in response to one-dot print command must have an increased density than a dot formed by a single ink droplet. However, when the continuously ejected droplets join together during the flight time toward the recording medium, the density of the dot printed on the recording medium is not as high as it is expected. Because a major part of the joined droplet is absorbed in the recording medium. In this case, the printed dot is almost as large as the dot printed by ejecting a single droplet. However, the print density does not increase despite a large amount of ink consumption.

SUMMARY OF THE INVENTION

In view of the foregoing, it is an object of the present invention to provide an ink ejection device capable of forming a high density dot with two or more ink droplets that are continuously ejected one from another from the same nozzle.

It is another object of the present invention to provide a method for driving such an ink ejection device.

These and other objects of the present invention will be attained by an ink ejection device including a nozzle plate formed with nozzles from which ink is ejected; walls including side walls, a ceiling wall and a bottom wall; and a control unit that drives the actuator in response to a one-dot printing command commanding to print a one dot image on a recording medium. The walls define an ink channel. The ink channel has a volume filled with ink. The nozzle plate is attached to one end of the ink channel. Ink is supplied to the ink channel from another end of the ink channel. The side walls are made from a piezoelectric material and serve as an actuator that applies pressure wave vibrations to the ink in the ink channel. The actuator successively ejects a plurality of ink droplets to print one dot image on the recording medium. The actuator is driven to eject the plurality of ink droplets so that at least two ink droplets ejected from a nozzle do not join together before reaching the recording medium. The plurality of ink droplets form print dot images on the recording medium in a positionally offset relation.

With the ink ejection device thus constructed, the plurality of ink droplets do not join together during their flight times. Therefore, the ink droplets are successively deposited onto the recording medium. Because the ink ejection device moves relative to the recording medium during printing. the ink droplets are deposited in a positionally offset relation. That is, the ink droplets are not completely separately deposited on the recording medium but partially overlapped to form a single dot image. As such, the size of the dot image is enlarged when compared with a dot image formed by a single ink droplet. Thus, it is capable of forming a high density image.

Preferably, the actuator successively ejects two ink droplets to print one dot image on the recording medium. In this case, the control unit drives the actuator at a particular timing so that two ink droplets do not join together.

The control unit drives the actuator to first increase the volume of the ink channel and to then decrease the volume of the ink channel to eject each of the plurality of ink droplets. The control unit drives the actuator for a duration of time T corresponding to a time required for the ink pressure wave vibrations to propagate one way through the ink channel to eject an n-th ink droplet of the plurality of ink droplets where n is an integer equal to or greater than two. When the volume of the ink chamber is increased, the pressure inside the ink chamber decreases, allowing ink to flow into the chamber. After the duration of time T required for pressure wave vibrations in the ink to propagate once across the length of the ink channel, the control unit drives the actuator to decrease the volume of the ink chamber. The pressure inside the ink chamber becomes relatively high, causing ink to be ejected from the corresponding nozzle.

The control unit drives the actuator to eject an (n+1)th ink droplet following the n-th ink droplet after an interval of a time from the ejection of the n-th ink droplet. The interval of the time is defined by 0.7 to 1.6 times as long as the duration of time T. The control unit drives the actuator for a predetermined duration of time to eject the (n+1)th ink droplet. The predetermine duration of time is unequal to the duration of time T when the interval of time is also equal to the duration of time T.

When ejecting the (n+1)th ink droplet, the control unit drives the actuator for a duration of time substantially equal to:

1.7 times as long as the duration of time T when the predetermined duration of time is equal to 0.7 times as long as the duration of time T;

0.8, 1.0, 1.4 or 1.7 times as long as the duration of time T when the predetermined duration of time is equal to 0.8 times as long as the duration of time T;

0.8 times as long as the duration of time T when the predetermined duration of time is equal to 0.9 or 1.0 times as long as the duration of time T;

0.5 or 0.6 times as long as the duration of time T when the predetermined duration of time is equal to 1.2 times as long as the duration of time T;

0.5 or 1.0 times as long as the duration of time T when the predetermined duration of time is equal to 1.3 times as long as the duration of time T;

1.0 times as long as the duration of time T when the predetermined duration of time is equal to 1.4 times as long as the duration of time T;

0.5, 0.7 or 1.0 times as long as the duration of time T when the predetermined duration of time is equal to 1.5 times as long as the duration of time T; and 1.7 times as long as the duration of time T when the predetermined duration of time is equal to 1.9 times as long as the duration of time T.

The control unit may drive the actuator for a duration of time in a range of ±5% of the duration of time as mentioned above.

The control unit drives the actuator after ejection of the plurality of ink droplets to cancel the pressure wave vibrations remaining in the ink of the ink channel.

According to another aspect of the invention, the control unit drives the actuator for a first duration of time to eject an n-th ink droplet of the plurality of ink droplets, the control unit drives the actuator for a second duration of time to eject an (n+1)th ink droplet following the n-th ink droplet, the (n+1)th ink droplet being ejected after an interval of a time from the ejection of the n-th ink droplet. In this case, at least one of the first duration of time, the second duration of time, and the interval of the time are set to be unequal to a duration of time T corresponding to a time required for the ink pressure wave vibrations to propagate one way through the ink channel.

At least one of the first duration of time, the second duration of time, and the interval of the time is unequal to an odd multiple of the duration of time T.

According to still another aspect of the invention, there is provided an ink ejection device, including: a nozzle plate formed with nozzles from which ink is elected; walls including side walls, a ceiling wall and a bottom wall; and a control unit that outputs a plurality of drive signals to the actuator in response to a one-dot printing command commanding to print a one dot image on a recording medium. The walls define an ink channel. The ink channel has a volume filled with ink. The nozzle plate is attached to one end of the ink channel, and ink is supplied to the ink channel from another end of the ink channel. The side walls serve as an actuator that applies pressure wave vibrations to the ink in the ink channel. The actuator generating in the ink of the ink channel a pressure wave vibration having a peak when each of the plurality of drive signals is applied to the actuator, causing an ink droplet to eject. The control unit outputs the plurality of drive signals at timings that do not allow the peak of the pressure wave vibration to be in coincidence with an existing peak of the pressure wave vibration occurring in the ink of the ink channel. The actuator first increases the volume of the ink channel and then decreases the volume of the ink channel to eject each of the plurality of ink droplets. Preferably, the control unit applies voltage signals to the actuator to eject the plurality of ink droplets. The voltage signals have the same level.

BRIEF DESCRIPTION OF THE DRAWINGS

The particular features and advantages of the invention as well as other objects will become apparent from the following description taken in connection with the accompanying drawings, in which:

FIG. 1(*b*) is a cross-sectional view taken along a line B—B in FIG. 1(*a*), showing the configuration of the conventional ink ejection device shown in FIG. 1(*a*);

FIG. 4(*a*) is a timing chart showing pulse waves issued by a charge circuit of the control unit;

FIG. 4(*b*) is a timing chart showing pulse waves issued by a discharge circuit of the control unit;

FIG. 4(*c*) is a timing chart showing the voltage applied to an actuator;

FIG. 5 is an explanatory diagram showing the construction of the ROM in the control unit;

FIG. 6(*b*) is an explanatory diagram showing the pressure wave vibration in the ink channel;

FIG. 7(*b*) is an explanatory diagram showing a cross-section of the dot in FIG. 7(*a*);

FIG. 7(C) is an explanatory diagram showing a dot formed on a recording medium by two continuously ejected ink droplets that did not join together during a flight time toward the recording medium but impinged upon the recording head one after another; and FIG. 7(*d*) is an explanatory diagram showing a cross-section of the dot in FIG. 7(*c*).

DETAILED DESCRIPTION OF THE PREFERRED EMBODIMENTS

Figure 1:
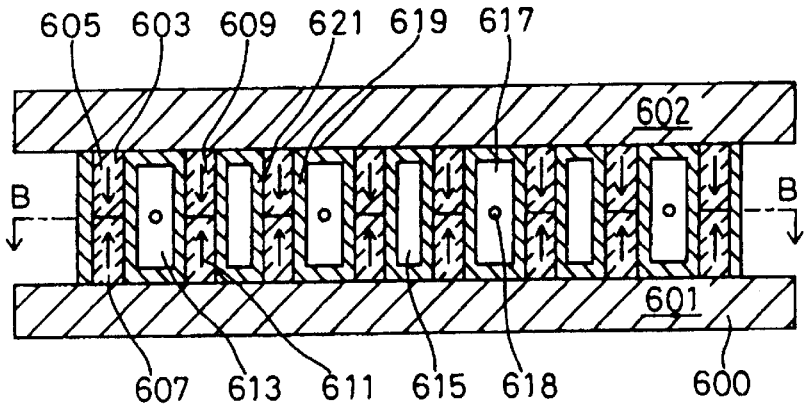
FIG. 1 (a) PRIOR ART
FIG. 1(*a*) is a cross-sectional view taken along a line A—A in FIG. 1(*b*), showing the configuration of a conventional ink ejection device.
Figure 1:
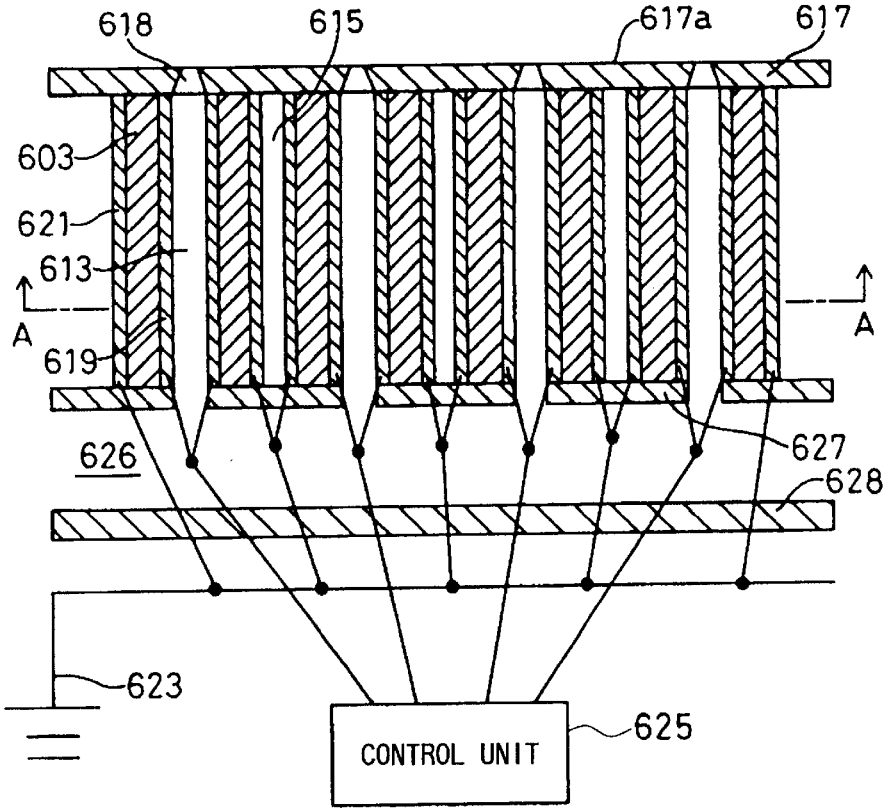
FIG. 1 (b) PRIOR ART

An ink ejection device according to preferred embodiments of the present invention will be described while referring to the accompanying drawings. A description of the mechanical parts in the ink ejection device 600 of the present embodiment will be omitted, as the construction of these parts is the same as the conventional device shown in FIGS. 1(*a*) and 1(*b*).

First the dimensions of the ink ejection device 600 will be described. The length L of the ink channel 613 is 7.5 mm. The diameter of the nozzles 618 on the nozzle plate 617*a* side is 40 $\mu$m. The diameter thereof on the ink channel 613 side is 72 $\mu$m. The length of the nozzles 618 is 100 $\mu$m. The ink supplied for the experiment described below has a viscosity of approximately 2 mPa·s at 25° C. and a surface tension of 30 mN/m. The ratio L/a, where L is the length L described above and a is the speed of sound in the ink of the ink channel 613, is 8 $\mu$sec. L/a equals the time T required for a pressure wave to propagate once across the length of the ink channel 613. The value a for the speed of sound is the value at room temperature (25° C.). The ink ejection device 600 is mounted on a carriage that moves along a platen (not shown), forming a gap of 1–2 mm between the nozzle plate 617*a* and the recording paper (not shown) on the platen.

Figure 3:
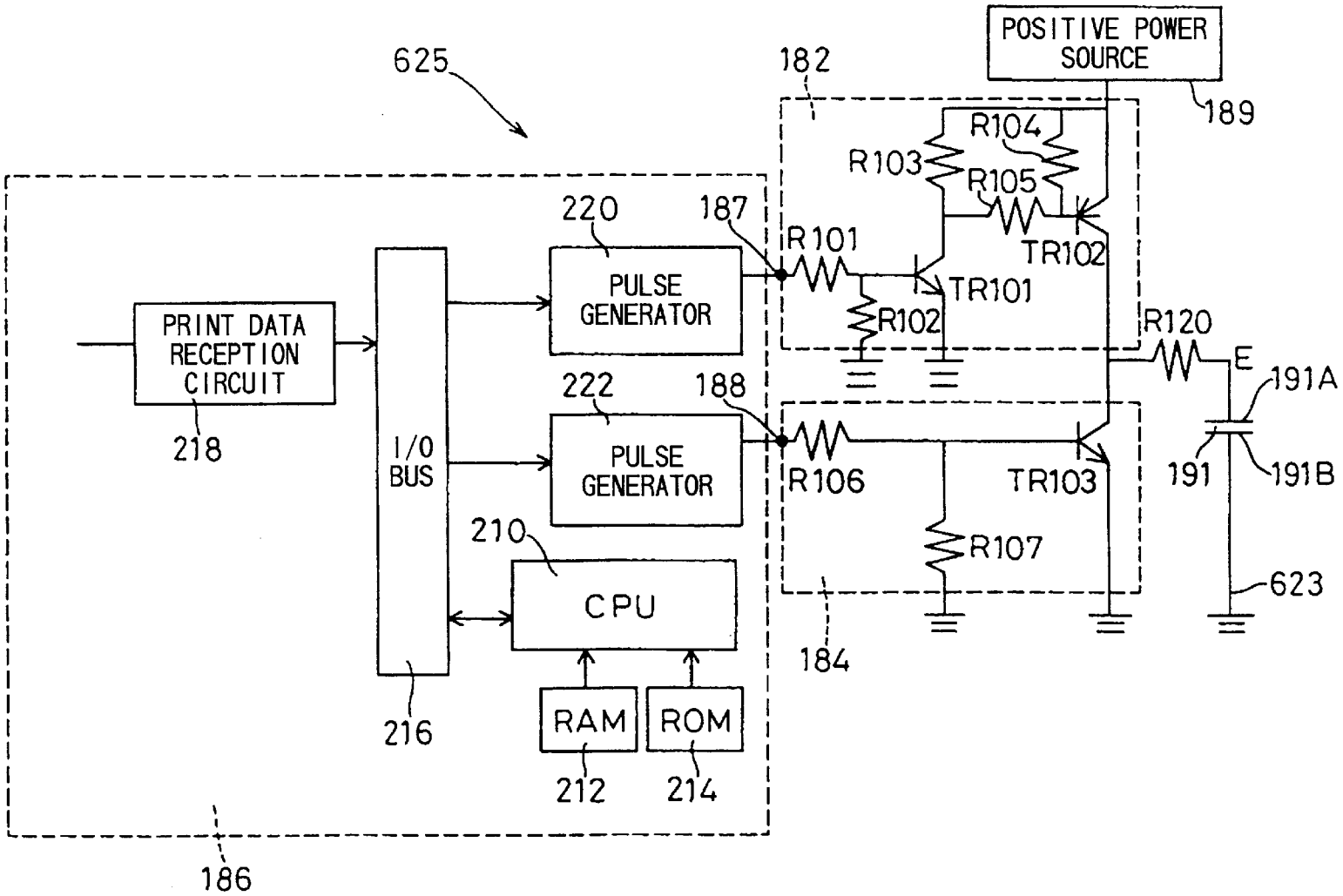
FIG. 3 is a circuit diagram for a control unit used in the ink ejection device according to the present invention.

FIG. 3 is a circuit diagram showing the construction of the control unit 625 used in the ink ejection device 600 of the present embodiment. As shown in FIG. 3, the control unit 625 includes a charge circuit 182, a discharge circuit 184, and a pulse control circuit 186. The piezoelectric materials and the electrodes 619 and 621 of the actuator wall 603 are represented by a capacitor 191, where a terminal 191A and a terminal 191B of the capacitor 191 correspond to the electrode 619 and electrode 621, respectively. In other words, the terminal 191A is connected to the control unit 625, while the terminal 191B is connected to ground 623.

An input terminal 187 provided on the charge circuit 182 and an input terminal 188 provided on the discharge circuit 184 receives pulse signals from the pulse control circuit 186 described later. In response to these pulse signals, a voltage of either E volts (for example, 20 volts) or 0 volts is applied to the electrode 619 (terminal 191A) in the ink channel 613.

The charge circuit 182 includes resistors R101, R102, R103, R104, and R105; and transistors TR101 and TR102. The base of the transistor TR101 is connected to the input terminal 187 via the resistor R101 and is grounded via the resistor R102. The emitter of the transistor TR101 is directly grounded, while the collector thereof is connected to a positive power source 189 via the resistor R103. The base of the transistor TR102 is connected to the positive power source 189 via the resistor R104 and is connected to the collector of the transistor TR101 via the resistor R105. The emitter of the transistor TR102 is connected directly to the positive power source 189, while the collector thereof is connected to the terminal 191A via a resistor R120.

With this construction, if an ON signal (+5 volts) is applied to the input terminal 187 of the charge circuit 182, the transistor TR101 is rendered conductive, and current from the positive power source 189 flows from the collector in the transistor TR101 toward the emitter. Accordingly, the voltage developed across the resistor R104 increases, causing an increase in the base current of the transistor TR102 and rendering the transistor TR102 conductive. Then, a voltage E volts from the positive power source 189 is applied to the terminal 191A via the emitter/collector junction of the transistor TR102 and the resistor R120.

Next, the construction of the discharge circuit 184 will be described. The discharge circuit 184 includes a resistor R106, resistor R107, and a transistor TR103. The base of the transistor TR103 is connected to the input terminal 188 via the resistor R106 and is grounded via the resistor R107. The emitter of the transistor TR103 is directly grounded, while the collector thereof is connected to the terminal 191 A via the resistor R120 described above. With this construction, when an ON signal (+5 volts) is applied to the input terminal 188 of the discharge circuit 184, the transistor TR103 is rendered conductive, thereby grounding the terminal 191A via the resistor R120.

Next, variations of the voltages applied to the actuator wall 603, i.e., capacitor 191, according to the charge circuit 182 and discharge circuit 184 will be described.

An input signal applied to the input terminal 187 of the charge circuit 182 is shown in FIG. 4(*a*). Ordinarily, the signal is OFF. However, when ejecting ink, the signal is turned ON at a specified timing Ti and turned OFF at a specified timing T2, described later. The signal is subsequently turned ON again at a timing T3 and turned OFF at a timing T4. Once again, the signal is turned ON at a specified timing T5 and turned OFF at a timing T6. An input signal applied to the input terminal 188 of the discharge circuit 184 is shown in FIG. 4(*b*). This signal is turned OFF when the signal applied to the input terminal 187 is turned ON, that is, at T1, T3, and T5. The signal is turned ON when the signal applied to the input terminal 187 is turned OFF, that is, at T2, T4, and T6.

FIG. 4(*c*) shows the voltage appearing at the terminal 191A during this time. Normally, the voltage is maintained at 0 volts. Charging of the capacitor 191, that is, the actuator wall 603, starts at the timing T1. The voltage across the capacitor 191 reaches E volts after a charge time Ta determined by the transistor TR102, the resistor R120, and the electrostatic capacitance of the actuator wall 603 made from a shear mode type piezoelectric material. At the timing T2, discharging of the capacitor 191 begins, and the voltage drops to 0 volts after a discharge time Tb determined by the transistor TR103, the resistor R120, and the electrostatic capacitance of the actuator wall 603.

The voltage E volts appears at the electrode 619 after the time delay Ta from the application of the ON signal to the input terminal 187 of the charge circuit 182. Also, 0 volts appears at the electrode 619 after the time delay Tb from the stoppage of the application of the ON signal. Due to the delays Ta and Tb in the rising and falling edges in the voltage (hereinafter referred to as the "drive signal") appearing at the electrode 619, the points at which the voltage is a half of E volts (for example, 10 volts) is represented by rising timings AS, BS, and HS, and at falling timings AE, BE, and HE. The pulse control circuit 186 controls the timings T1–T6 of the signals applied to the input terminals 187 and 188 to achieve desirable rising and falling timings described later.

Next, the pulse control circuit 186 will be described with reference to FIG. 3. The pulse control circuit 186 is provided with a CPU 210 for performing various calculations; a RAM 212 for storing print and various other data; a ROM 214 for storing control programs for the pulse control circuit 186 and sequence data for generating ON and OFF signals at the timings T1–T6 described above; pulse generators 220 and 222 for generating pulses to be applied to the input terminals 187 and 188, respectively; a print data reception circuit 218 for receiving print commands from a host computer (not shown); and an I/O bus 216. The I/O bus 216 transfers data between the print data reception circuit 218, pulse generators 220 and 222, and CPU 210.

As shown in FIG. 5, the ROM 214 includes an ink ejection device control program storage area 214A and a drive waveform data storage area 214B. The sequence data specifying the waveform of the drive signal is stored in the drive waveform data storage area 214B.

The CPU 210 controls the pulse generators 220 and 222 based on the sequence data stored in the drive waveform data storage area 214B. Therefore, by storing all the patterns of timings T1–T6 in the storage area 214B, a drive signal having a desired waveform can be applied to the actuator wall 603 in response to a one-dot print command. The number of pulse generators 220 and 222, charge circuits 182, and discharge circuits 184 provided exactly equals the number of nozzles 618 in the ink ejection device 600. The CPU 210 outputs a drive signal to the actuator wall 603 in response to print data to eject ink from the corresponding nozzle 618.

Next, an example waveform of the drive signal (hereinafter referred to as "drive waveform") in an ink ejection device 600 according to the present embodiment will be described with reference to FIG. 6(*a*). Further, FIG. 6(*b*) illustrates pressure changes in the ink channel 613 in response to this drive waveform. The ink ejection device 600 outputs the drive signals shown in FIG. 6(*a*) while being moved by a carriage (not shown).

Figure 6:
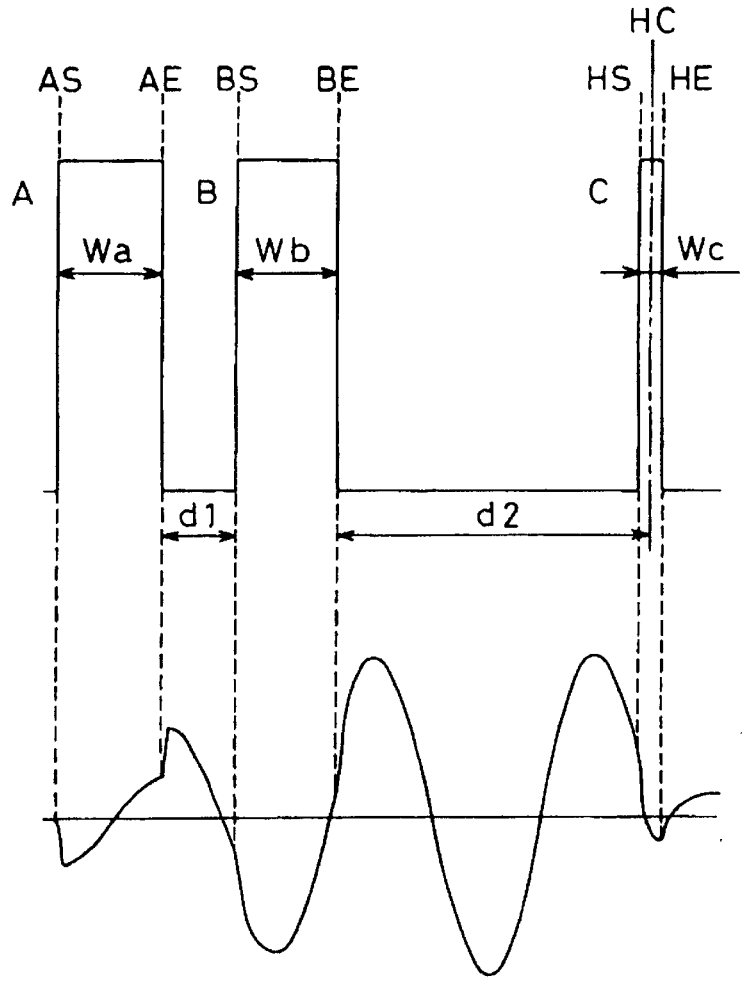
FIG. 6(*a*) is an explanatory diagram showing an example drive waveform output from the control unit of the ink ejection device.

As shown in FIG. 6(*a*), the drive waveform of the present example includes two ejection pulse signals A and B for ejecting ink and one non-ejection pulse signal C for canceling the residual pressure wave vibrations in the ink channel 613. With the two ejection pulse signals A and B two ink droplets are continuously ejected one after another from a nozzle, forming a dot 99 shown in FIG. 7(*c*). All of the pulse signals A, B, and C have a wave height (voltage) of E volts.

Figure 2:
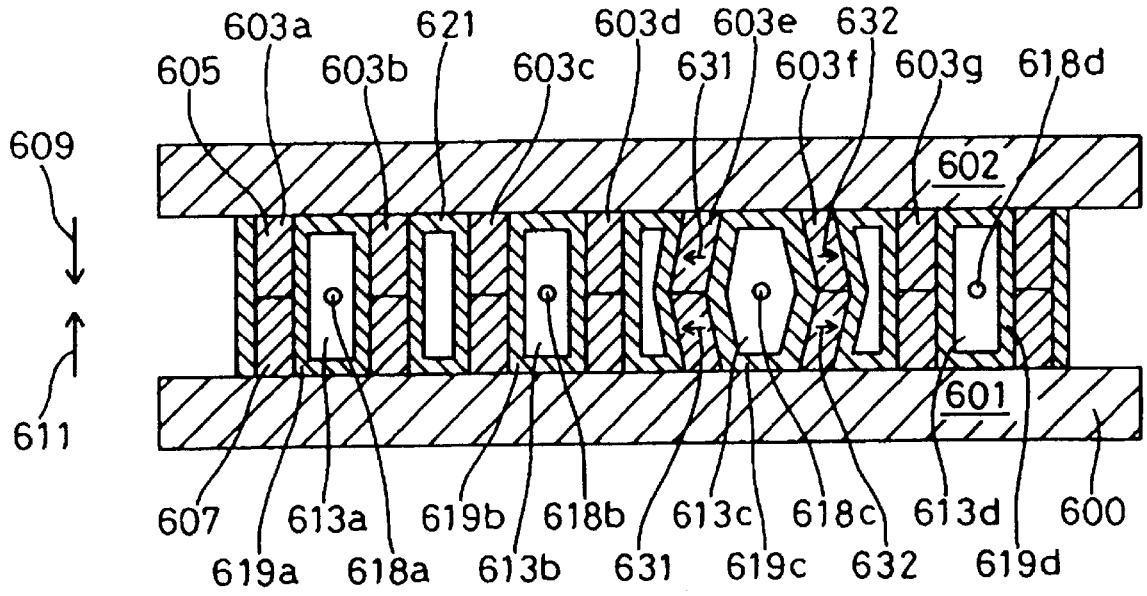
FIG. 2 PRIOR ART
FIG. 2 is an explanatory diagram showing an example operation executed by the ink ejection device of FIGS. 1(*a*) and 1(*b*)

As described in the example of ink channel 613*c* of FIG. 2, when the ejection pulse signal A rises at the timing AS, an electric field is developed in the actuator wall 603, causing the volume of the ink channel 613 to increase and the internal pressure of the same to decrease, including the area near the nozzle 618. At this time, ink flows into the ink channel 613, and pressure wave vibrations generated by the increased volume increase the internal pressure to a positive pressure, reaching a peak approximately after an interval of time (the pressure wave propagation time) T has elapsed. The ejection pulse signal A drops at the timing AE. At this time, the volume of the ink channel 613 decreases. The pressure generated by this decrease in volume adds to the positive pressure described above to generate a relatively high pressure near the nozzle 618, causing the first ink droplet to eject from the same.

The ejection pulse signal B rises at the timing BS (when the pressure in the ink channel 613 is changed from negative to positive) after elapse of a predetermined duration of time d1 from the timing AE. The ejection pulse signal B drops at the timing BE after the pressure wave propagation time T has elapsed, causing the second ink droplet to eject from the nozzle 618.

Subsequently, the non-ejection pulse signal C is generated after the pulse interval d2. The pulse signal C rises at the timing HS before the pressure in the ink channel 613 changes from positive to negative. The pulse signal C drops at the timing HE where the pressure in the ink channel 613 changes from positive to negative. If the non-ejection pulse signal C rises at the timing HS, the still positive pressure in the ink channel 613 can be quickly decreased. Further, if the non-ejection pulse signal C drops at the timing HE after the pressure has become negative, the negative pressure can be quickly increased. Accordingly, the pressure wave vibrations can be canceled, allowing the vibrations to quickly converge. As a result, it is possible to prevent unintentional ink ejection and to quickly proceed to processing the next print command. Therefore, an ink ejection device of the present invention not only can form very good images, but also can improve printing speed.

In this manner, the ink ejection device 600 of the present embodiment elects two ink droplets 99 continuously in response to one-dot print command. Therefore, it is possible to form a higher density and higher contrast image on the recording medium 97 than the image formed by ejecting only a single ink droplet 99 toward the recording medium 97. However, this cannot be accomplished if the continuously ejected two droplets 99 join together before they reach the recording medium 97.

Figure 7:
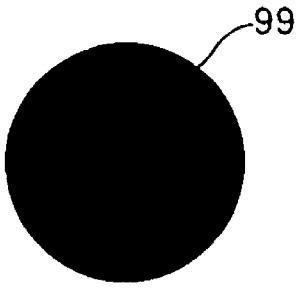
FIG. 7(*a*) is an explanatory diagram showing a dot formed on a recording medium by two continuously ejected ink droplets that joined together during a flight time toward the recording medium.
Figure 7:
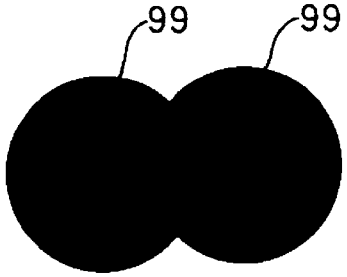
Figure 7:
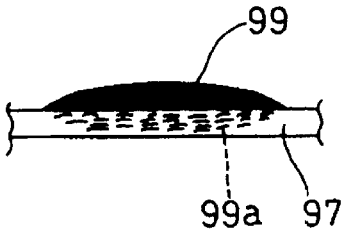
Figure 7:
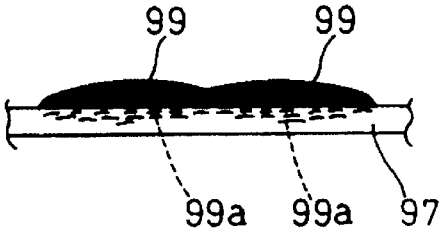

FIG. 7(*a*) is a plan view showing the image formation by the two continuously ejected ink droplets which joined together before reaching the recording medium 97. FIG. 7(*b*) is a cross-sectional view of the image formation in FIG. 7(*a*). When the two ink droplets join together during their flight times toward the recording medium 97, the resultant ink droplet becomes large in volume and size. However, a major part of the ink is absorbed in the recording medium 97, so the image formed by the joined droplet is only slightly larger than or as small as the one formed by a single droplet.

In order that the two droplets may not joint together during their flight times, the inventor of the present invention tried to find appropriate values for the parameters including first pulse interval d1, second pulse interval d2 from the timing BE to the midpoint timing HC between the timings HS and HE, and pulse widths Wa, Wb and Wc of the pulse signals A, B and C.

If the parameters Wa, Wb and d1 are set to the pressure wave propagation time T or odd multiple thereof, the amplitude of the pressure wave vibrations in the ink channel becomes gradually large, causing the second ink droplet to eject at a speed faster than the first ink droplet. The second droplet catches up the first one and finally the two join together. In view of the above recognition, the inventor selected the values appropriate for the parameters Wa, Wb and d1 so that at least one of the three parameters is not equal to the duration of time T or an odd multiple thereof. By so doing, the two droplets are prevented from joining together before reaching the recording medium. The locations of the two droplets impinging upon the recording medium 97 are slightly deviated from each other due to the movement of the carriage relative to the recording medium, and the dots formed by the two droplets are partially overlapped as shown in FIGS. 7(*c*) and 7(*d*).

Joining of the two droplets can also be prevented by generating the second ejection pulse signal B at the timing where the peak of the pressure wave vibrations generated by the ejection pulse signal B do not superimpose upon the peak of the pressure wave vibrations previously generated by the ejection pulse signal A. If this peak-to-peak superimposition occurs, the second droplet will be ejected under a higher pressure than the first droplet, causing the second droplet to fly at a higher speed than the first droplet. Thus, the second droplet catches up the first droplet and these two join together before reaching the recording medium 97.

The inventor conducted experiments to find optimum values for the parameters Wa, d1, Wb, d2 and Wc, which can prevent joining of the two continuously ejected droplets and also effectively cancel the pressure wave vibrations after ejection of the ink droplets. The results of the experiments are shown in Table 1 where the values of the above-mentioned parameters are given as a ratio to the pressure wave propagation time T.

TABLE

| Wa (×T) | d1 (×T) | Wb (×T) | d2 (×T) | Wc (×T) |
|---|---|---|---|---|
| 1.0 | 1.2 | 0.6 | 1.8 | 1.7 |
| 1.0 | 1.5 | 0.7 | 1.7 | 1.7 |
| 1.0 | 0.8 | 1.4 | 1.6 | 1.7 |
| 1.0 | 0.8 | 1.4 | 2.2 | 0.5 |
| 1.0 | 1.2 | 0.6 | 2.4 | 0.5 |
| 1.0 | 1.5 | 0.7 | 2.3 | 0.5 |
| 1.0 | 1.3 | 0.5 | 2.5 | 0.5 |
| 1.0 | 1.3 | 0.5 | 1.9 | 1.5 |
| 1.0 | 1.9 | 1.7 | 1.9 | 0.5 |
| 1.0 | 1.3 | 1.0 | 2.2 | 0.5 |
| 1.0 | 1.4 | 1.0 | 1.7 | 1.5 |
| 1.0 | 1.5 | 1.0 | 2.2 | 0.5 |
| 1.0 | 1.5 | 1.0 | 1.7 | 1.5 |
| 1.0 | 1.4 | 1.0 | 2.2 | 0.5 |
| 1.0 | 1.6 | 1.0 | 2.4 | 0.5 |
| 1.0 | 1.0 | 0.8 | 2.4 | 0.5 |
| 1.0 | 0.8 | 1.0 | 2.3 | 0.5 |
| 1.0 | 0.7 | 1.7 | 2.0 | 0.5 |

TABLE-continued

| Wa (×T) | d1 (×T) | Wb (×T) | d2 (×T) | Wc (×T) |
|---|---|---|---|---|
| 1.0 | 1.4 | 1.0 | 2.3 | 0.5 |
| 1.0 | 0.7 | 1.7 | 2.0 | 0.5 |
| 1.0 | 1.2 | 0.5 | 2.5 | 0.5 |
| 1.0 | 1.0 | 0.8 | 2.4 | 0.5 |
| 1.0 | 1.5 | 1.0 | 2.3 | 0.5 |
| 1.0 | 1.5 | 0.5 | 2.5 | 0.5 |
| 1.0 | 1.2 | 0.5 | 2.5 | 0.5 |
| 1.0 | 0.9 | 0.8 | 2.4 | 0.5 |
| 1.0 | 0.8 | 0.8 | 2.4 | 0.5 |
| 1.0 | 0.8 | 1.7 | 2.0 | 0.5 |
| 1.0 | 1.5 | 1.0 | 2.0 | 0.5 |
| 1.0 | 0.9 | 0.8 | 2.5 | 0.5 |
| 1.0 | 0.9 | 0.8 | 2.6 | 0.4 |

When the parameters Wa, d1, Wb, d2 and Wc are set to the values as shown in the Table, the ink droplets could be prevented from joining together during their flight time towrd the recording medium 97. In addition, the two ink droplets can be printed on the recording medium 97 in a partially overlapping manner as shown in FIG. 7(*c*). The ink does not permeate into a deeper level of the recording medium as compared with the dot in FIGS. 7(*a*) and 7(*b*), and the size of the printed dot on the recording medium is almost two times as large as the dot shown in FIGS. 7(*a*) and 7(*b*). As such, a high density image can be printed on the recording medium 97. In addition, the printing speed can be greatly improved by converging the pressure wave vibrations of the ink at an early stage.

The amount of shift of the two ink droplets 99 can be determined as desired by adjusting the moving speed of the carriage, ejection speed of the ink droplets 99, and the value for the parameter d1. When the two droplets are printed in a non-overlapping manner, the printed area is maximized and so the highest density printing can be achieved.

The parameters Wa, d1, Wb, d2 and Wc may not be strictly set to the values shown in the Table but a deviation of about ±0.05 (×T) with respect to the values shown in the Table does not affect to the operational advantages described above. Although the experiments indicated that the values shown in the Table are appropriate, there may exist another values which also provide the similar operational advantages. Particularly, when the experimental conditions are changed, for example, when the distance between the nozzle face 617*a* and the recording medium 97 is changed, there may be another appropriate values for the parameters shown in the Table.

While the invention has been described in detail with reference to specific embodiments thereof, it would be apparent to those skilled in the art that many modifications and variations may be made therein without departing from the spirit of the invention, the scope of which is defined by the attached claims. For example, in the embodiment described above, two ink droplets are successively ejected in response to one-dot print command commanding to print one dot, however, three or more droplets may be successively ejected in response thereto. In the latter case, a high density image can be printed if at least two of more than three droplets do not join together during their flight times.

As a modification, it is possible to set the speed of the secondly ejected ink droplet so as not to catch up the first ejected ink droplet or it is possible not to eject ink when canceling the pressure wave vibrations. These can be accomplished by setting the level of the ejection pulse signal B or the non-ejection pulse signal C to be lower than E(v).

Since the ejection and canceling operations in the embodiment described above are executed by setting the pulse signals A, B, and C to fixed values and adjusting the output timings AS-HE, only one power source is needed for outputting all of the pulse signals, greatly simplifying both construction and control of the device.

The present invention can be applied to devices for ejecting ink by quickly reducing the volume of the ink channel 613; to devices for applying pressure wave vibrations to ink via means other than actuators formed with a piezoelectric material; and to line printers having an ink ejection device 600 fixed to the body of the printing device. However, when using an actuator formed from piezoelectric elements as described above, the device can be made simpler to construct, more durable, and less expensive to produce. The line printer to which the present invention is applied can form high density images on the recording medium with a partially overlapped dots, wherein a plurality of ink droplets are successively ejected while feeding the recording medium.

What is claimed is:

1. An ink ejection device, comprising:

a nozzle plate formed with nozzles from which ink is ejected;

walls including side walls, a ceiling wall and a bottom wall, the walls defining an ink channel having a volume filled with ink and having a length defined by two ends, said nozzle plate being attached to one of the two ends of the ink channel, ink being supplied to the ink channel from another one of the two ends of the ink channel;

an actuator that applies pressure wave vibrations to the ink in the ink channel; and a control unit that drives said actuator in response to a one-dot printing command commanding to print a one dot image on a recording medium, wherein said actuator successively ejects a plurality of ink droplets that are non-joinable during their flight time toward the recording medium to print a dot image on the recording medium, said actuator being driven to eject the plurality of ink droplets, wherein said actuator is driven for a first duration of time to eject an n-th ink droplet of the plurality of ink droplets, and for a second duration of time to eject an (n+1)th ink droplet following the n-th ink droplet, the (n+1) h ink droplet being ejected after an interval of a time from the ejection of the n-th ink droplet, the droplets being deposited on the recording medium in a partially overlapping manner, wherein at least one of the first duration of time, the second duration of time, and the interval of the time is unequal to a duration of time T corresponding to a time required for the ink pressure wave vibrations to propagate one way through the ink channel.

2. The ink ejection device as claimed in claim 1, wherein when said actuator is driven in response to a one-dot printing command, said actuator successively ejects two ink droplets to print one dot image on the recording medium.

3. The ink ejection device as claimed in claim 1, wherein said actuator ejects the plurality of ink droplets toward the recording medium while moving relative to the recording medium.

4. The ink ejection device as claimed in claim 1, wherein said control unit drives said actuator to first increase the volume of the ink channel and to then decrease the volume of the ink channel to eject each of the plurality of ink droplets.

5. The ink ejection device as claimed in claim 4, wherein said control unit drives said actuator for a duration of time T corresponding to a time required for the ink pressure wave vibrations to propagate one way through the ink channel to eject an n-th ink droplet of the plurality of ink droplets.

6. The ink ejection device as claimed in claim 5, wherein said control unit drives said actuator to eject an (n+1)th ink droplet following the n-th ink droplet after an interval of a time from the ejection of the n-th ink droplet, the interval of the time being defined by 0.7 to 1.6 times as long as the duration of time T.

7. The ink ejection device as claimed in claim 5, wherein said control unit drives said actuator for a predetermined duration of time to eject the (n+1)th ink droplet, the predetermine duration of time being unequal to the duration of time T when the interval of time is also equal to the duration of time T.

8. The ink ejection device as claimed in claim 7, wherein when ejecting the (n+1)th ink droplet, said control unit drives said actuator for a duration of time substantially equal to:

1.7 times as long as the duration of time T when the predetermined duration of time is equal to 0.7 times as long as the duration of time T;

0.8, 1.0, 1.4 or 1.7 times as long as the duration of time T when the predetermined duration of time is equal to 0.8 times as long as the duration of time T;

0.8 times as long as the duration of time T when the predetermined duration of time is equal to 0.9 or 1.0 times as long as the duration of time T;

0.5 or 0.6 times as long as the duration of time T when the predetermined duration of time is equal to 1.2 times as long as the duration of time T;

0.5 or 1.0 times as long as the duration of time T when the predetermined duration of time is equal to 1.3 times as long as the duration of time T;

1.0 times as long as the duration of time T when the predetermined duration of time is equal to 1.4 times as long as the duration of time T;

0.5, 0.7 or 1.0 times as long as the duration of time T when the predetermined duration of time is equal to 1.5 times as long as the duration of time T; and 1.7 times as long as the duration of time T when the predetermined duration of time is equal to 1.9 times as long as the duration of time T.

9. The ink ejection device as claimed in claim 8, wherein when ejecting the second ink droplet, said control unit drives said actuator for a duration of time in a range of ±5% of the duration of time defined in claim 8.

10. The ink ejection device as claimed in claim 9, said control unit drives said actuator after ejection of the plurality of ink droplets to cancel the pressure wave vibrations remaining in the ink of the ink channel.

11. The ink ejection device as claimed in claim 1, wherein at least one of the first duration of time, the second duration of time, and the interval of the time is unequal to an odd multiple of the duration of time T.

12. The ink ejection device as claimed in claim 1, wherein said side walls serve as said actuator and are made from a piezoelectric material.

13. An ink ejection device, comprising:

a nozzle plate formed with nozzles from which ink is ejected;

walls including side walls, a ceiling wall and a bottom wall, said walls defining an ink channel having a volume filled with ink and having a length defined by two ends, said nozzle plate being attached to one of the two ends of the ink channel, ink being supplied to the ink channel from another one of the two ends of the ink channel;

an actuator that applies pressure wave vibrations to the ink in the ink channel; and a control unit that outputs a plurality of drive signals to said actuator in response to a one-dot printing command commanding to print a one dot image on a recording medium, said actuator generating in the ink of the ink channel a pressure wave vibration having a peak when each of the plurality of drive signals is applied to said actuator, causing ink droplets, that are non-joinable during their flight time toward the recording medium, to eject, wherein said control unit outputs the plurality of drive signals at timings that do not allow the peak of the pressure wave vibration to be in coincidence with an existing peak of the pressure wave vibration occurring in the ink of the ink channel; and wherein the droplets being deposited on the recording medium in a partially overlapping manner.

14. The ink ejection device as claimed in claim 13, wherein said actuator first increases the volume of the ink channel and then decreases the volume of the ink channel to eject each of the plurality of ink droplets.

15. The ink ejection device as claimed in claim 14, wherein said control unit applies voltage signals to said actuator to eject the plurality of ink droplets, the voltage signals having the same level.

16. A method for driving an ink ejection device that includes: a nozzle plate formed with nozzles from which ink is ejected; walls including side walls, a ceiling wall and a bottom wall, the walls defining an ink channel having a volume filled with ink and having a length defined by two ends, said nozzle plate being attached to one of the two ends of the ink channel, ink being supplied to the ink channel from another one of the two ends of the ink channel; and, an actuator that applies pressure wave vibrations to the ink in the ink channel, the method comprising the steps of:

driving said actuator in response to a one-dot printing command commanding to print a one dot image on a recording medium so that said actuator successively ejects a plurality of ink droplets that are non-joinable during their flight time toward the recording medium to print a dot image on the recording medium, the plurality of ink droplets being ejected at predetermined timings such that said actuator is driven for a first duration of time to eject an n-th ink droplet of the plurality of ink droplets, and for a second duration of time to eject an (n+1)th ink droplet following the n-th ink droplet, the (n+1)th ink droplet being ejected after an interval of a time from the ejection of the n-th ink droplet, the droplets being deposited on the recording medium in a partially overlapping manner, wherein at least one of the first duration of time, the second duration of time, and the interval of the time is unequal to a duration of time T corresponding to a time required for the ink pressure wave vibrations to propagate one way through the ink channel, and wherein said actuator ejects the plurality of ink droplets toward the recording medium while moving relative to the recording medium.

17. The method as claimed in claim 16, wherein when said actuator is driven in response to a one-dot printing command, said actuator successively ejects two ink droplets to print one dot image on the recording medium.

18. The method as claimed in claim 16, wherein said actuator first increases the volume of the ink channel and then decreases the volume of the ink channel to eject each of the plurality of ink droplets.

19. The method as claimed in claim 18, wherein said actuator is driven for a duration of time T corresponding to a time required for the ink pressure wave vibrations to propagate one way through the ink channel to eject an n-th ink droplet of the plurality of ink droplets.

20. The method as claimed in claim 19, wherein said actuator is driven to eject an (n+1)th ink droplet following the n-th ink droplet after an interval of a time from the ejection of the n-th ink droplet, the interval of the time being defined by 0.7 to 1.6 times as long as the duration of time T.

21. The method as claimed in claim 19, wherein said actuator is driven for a predetermined duration of time to eject the (n+1)th ink droplet, the predetermine duration of time being unequal to the duration of time T when the interval of time is also equal to the duration of time T.

22. The method as claimed in claim 21, wherein when ejecting the (n+1)th ink droplet, said actuator is driven for a duration of time substantially equal to:

1.7 times as long as the duration of time T when the predetermined duration of time is equal to 0.7 times as long as the duration of time T;

0.8, 1.0, 1.4 or 1.7 times as long as the duration of time T when the predetermined duration of time is equal to 0.8 times as long as the duration of time T;

0.8 times as long as the duration of time T when the predetermined duration of time is equal to 0.9 or 1.0 times as long as the duration of time T;

0.5 or 0.6 times as long as the duration of time T when the predetermined duration of time is equal to 1.2 times as long as the duration of time T;

0.5 or 1.0 times as long as the duration of time T when the predetermined duration of time is equal to 1.3 times as long as the duration of time T;

1.0 times as long as the duration of time T when the predetermined duration of time is equal to 1.4 times as long as the duration of time T;

0.5, 0.7 or 1.0 times as long as the duration of time T when the predetermined duration of time is equal to 1.5 times as long as the duration of time T; and 1.7 times as long as the duration of time T when the predetermined duration of time is equal to 1.9 times as long as the duration of time T.

23. The method as claimed in claim 22, wherein when ejecting the second ink droplet, said actuator is driven for a duration of time in a range of ±5% of the duration of time defined in claim 22.

24. The method as claimed in claim 23, said actuator is driven after ejection of the plurality of ink droplets to cancel the pressure wave vibrations remaining in the ink of the ink channel.

25. The method as claimed in claim 18, wherein said actuator is driven for a first duration of time to eject an n-th ink droplet of the plurality of ink droplets, and for a second duration of time to eject an (n+1)th ink droplet following the n-th ink droplet, the (n+1)th ink droplet being ejected after an interval of a time from the ejection of the n-th ink droplet, wherein at least one of the first duration of time, the second duration of time, and the interval of the time is unequal to a duration of time T corresponding to a time required for the ink pressure wave vibrations to propagate one way through the ink channel.

26. The method as claimed in claim 25, wherein at least one of the first duration of time, the second duration of time, and the interval of the time is unequal to an odd multiple of the duration of time T.

27. A method of an ink ejection device that includes:

a nozzle plate formed with nozzles from which ink is ejected; walls including side walls, a ceiling wall and a bottom wall, said walls defining an ink channel having a volume filled with ink and having a length defined by two ends, said nozzle plate being attached to one of the two ends of the ink channel, ink being supplied to the ink channel from another one of the two ends of the ink channel; and, an actuator that applies pressure wave vibrations to the ink in the ink channel, the method comprising the steps of: outputting a plurality of drive signals to said actuator in response to a one-dot printing command commanding to print a one dot image on a recording medium; said actuator generating in the ink of the ink channel a pressure wave vibration having a peak when each of the plurality of drive signals is applied to said actuator, causing ink droplets, that are non-joinable during their flight time toward the recording medium, to eject, wherein the plurality of drive signals are output at timings that do not allow the 5 peak of the pressure wave vibration to be in coincidence with an existing peak of the pressure wave vibration occurring in the ink of the ink channel; and wherein the droplets being deposited on the recording medium in a partially overlapping manner.

28. The method as claimed in claim 27, wherein said actuator first increases the volume of the ink channel and then decreases the volume of the ink channel to eject each of the plurality of ink droplets.

29. The method as claimed in claim 28, wherein voltage signals are applied to said actuator to eject the plurality of ink droplets, the voltage signals having the same level.

* * * * *